US006601253B1

(12) United States Patent
Tarquinio

(10) Patent No.: US 6,601,253 B1
(45) Date of Patent: Aug. 5, 2003

(54) MULTILAYER FOAM MATTRESS WITH SIDE SUPPORTS

(76) Inventor: Peter Tarquinio, 684 Valle Vista, Sierra Madre, CA (US) 91024

( * ) Notice: Subject to any disclaimer, the term of this patent is extended or adjusted under 35 U.S.C. 154(b) by 0 days.

(21) Appl. No.: 10/192,255

(22) Filed: Jul. 8, 2002

(51) Int. Cl.[7] ..... A47C 27/15
(52) U.S. Cl. ..... 5/739; 5/740; 5/727
(58) Field of Search ..... 5/727, 728, 730, 5/732, 739, 740

(56) References Cited

U.S. PATENT DOCUMENTS 4,975,996 A * 12/1990 Evans et al. ..... 5/731
5,179,742 A * 1/1993 Oberle ..... 5/727
5,669,094 A * 9/1997 Swanson ..... 5/740
5,819,349 A * 10/1998 Schwartz ..... 5/740
6,159,574 A 12/2000 Landvik et al.
6,249,924 B1 6/2001 Kluft
6,256,822 B1 * 7/2001 Weston et al. ..... 5/732
6,430,766 B1 * 8/2002 Henley et al. ..... 5/722

* cited by examiner

*Primary Examiner*—Michael F. Trettel
(74) *Attorney, Agent, or Firm*—Lynn & Lynn

(57) ABSTRACT

A mattress provides side support that reduces the likelihood that a person will accidentally roll off and also provides increased comfort to a person sitting on the side of the mattress. The mattress includes a top layer, a bottom layer and a buffer layer between the top and bottom layers. A pair of support members are placed in corresponding cavities near the opposite sides of the top layer. The support members are firmer than the top layer and are arranged to support the top layer and provide reduced compression of the mattress when a weight is placed on the upper surface of the top layer near the support members.

9 Claims, 2 Drawing Sheets

MULTILAYER FOAM MATTRESS WITH SIDE SUPPORTS

This invention relates generally to mattresses and cushions and particularly to a mattress comprising of a plurality of foam layers and a pair of support members in one of the foam layers.

SUMMARY OF THE INVENTION

The mattress according to the invention provides side support that reduces the likelihood that a person will accidentally roll off and also provides increased comfort to a person sitting on the side of the mattress. Accordingly, a mattress according to the invention comprises a top layer formed to comprise a viscoelastic foam material having a first indentation load deflection rating and an upper surface and a lower surface and first and second sides. The mattress further comprises a buffer layer adjacent the lower surface of the top layer. The buffer layer is formed to comprise a foam material having a second indentation load deflection rating that is greater than the first indentation load deflection rating. The mattress also comprises a bottom layer arranged such that the buffer layer is between the top and bottom layers. The bottom layer preferably is formed to comprise a foam material having a third indentation load deflection rating that is greater than the second indentation load deflection rating. The mattress according to the invention has a first support member placed adjacent the first side of the top layer and the buffer layer and a second support member placed adjacent the second side of the top layer and the buffer layer. The first and second support members are firmer than the top layer and are arranged to support the top layer and provide reduced compression of the mattress when a weight is placed on the upper surface of the top layer near the support members.

The top layer preferably is arranged to form first and second elongate wedge-shaped cavities between the first and second sides of the top layer and adjacent regions of the buffer layer. The first and second support members preferably comprise elongate wedge-shaped high resiliency foam structures positioned within the first and second cavities, respectively.

The mattress first and second support members preferably have corresponding first and second outer edge portions arranged to have a thickness such that they extend from the upper surface of the top layer to the buffer layer.

The top layer preferably has a 25% indentation load deflection rating of about 13, the buffer layer preferably has a 25% indentation load deflection rating of about 26, the bottom layer preferably has a 25% indentation load deflection rating of about 32 and each of the first and second support members preferably has a 25% indentation load deflection rating of about 32.

The features of the invention may be more fully understood, and appreciated by referring to the drawings described briefly below and by referring to the detailed description of the invention.

DETAILED DESCRIPTION OF THE INVENTION

Figure 1:
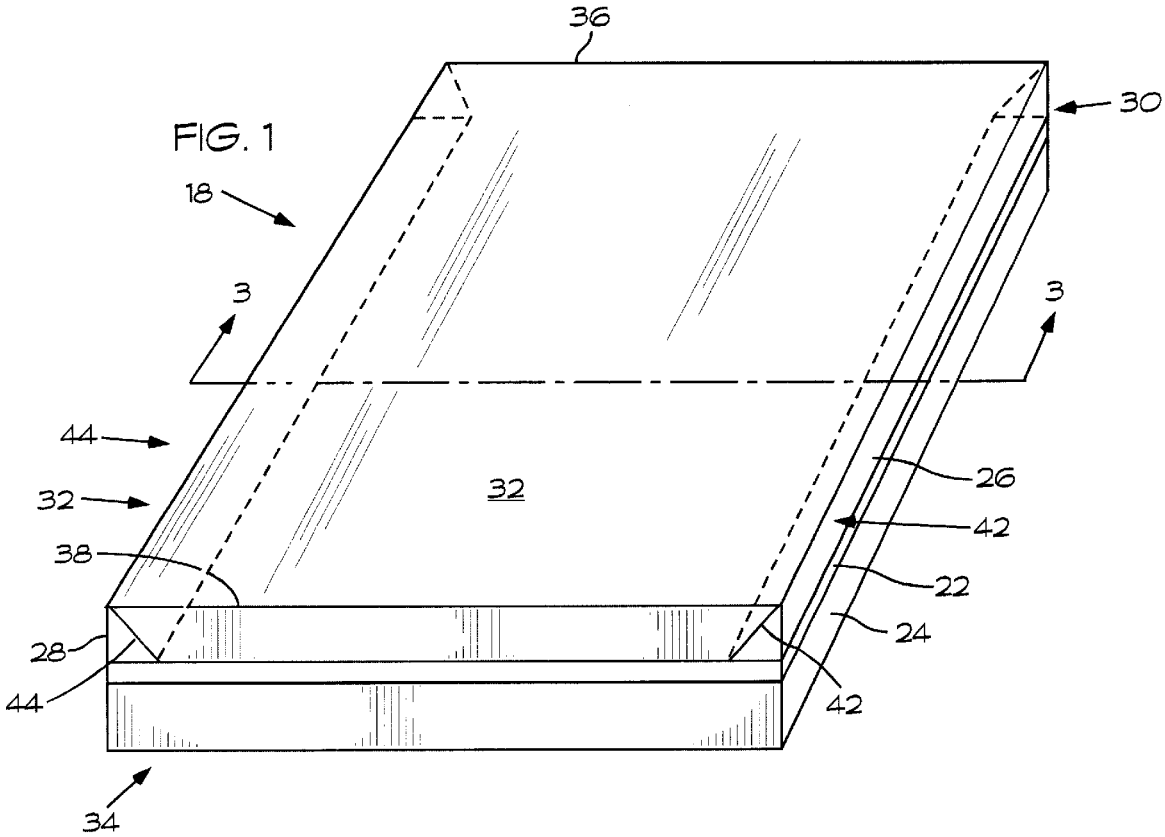
FIG. 1 is a perspective view of a mattress according to the invention showing a plurality of foam layers and a pair of side support members.
Figure 2:
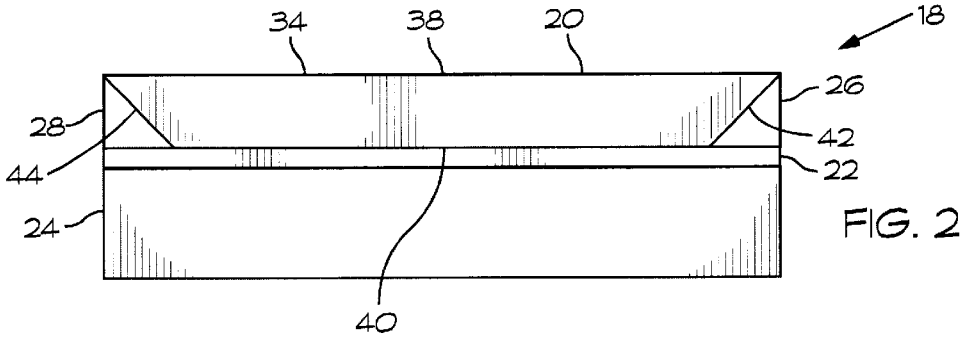
FIG. 2 is an end elevation view of the mattress of FIG. 1.
Figure 3:
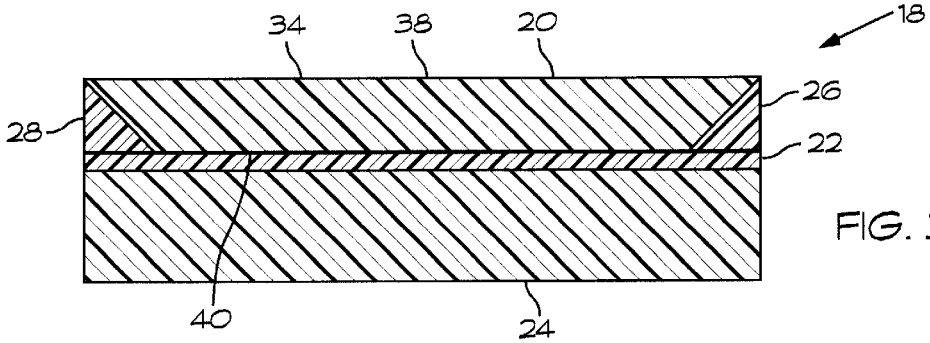
FIG. 3 is a cross sectional view along line 3—3 of FIG. 1.
Figure 4:
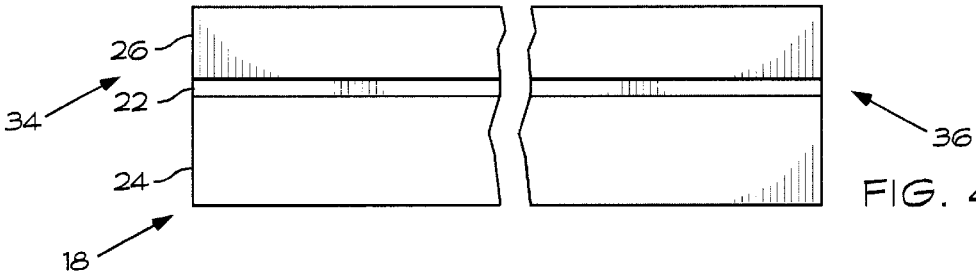
FIG. 4 is a side elevation view of the mattress of FIG. 1.

As shown in FIG. 1, a mattress 18 according to the invention includes a top layer 20, an intermediate layer 22 and a bottom layer 24. The top layer 20 includes a pair of side support members 26 and 28.

As shown in FIGS. 1–4, the top layer 20 has a pair of sides 30 and 32 and a pair of ends 34 and 36. The top layer 20 has a generally trapezoidal shape when viewed from the end 34 or in a cross section taken across the length of the mattress 18. In a preferred embodiment of the invention, the top layer has an upper surface 38 that has a greater width than its lower surface 40 to form elongate wedge-shaped notches 42 and 44 between the top layer 20 and the intermediate layer 22. Accordingly, the side supports 26 and 28 preferably are formed as elongate wedges that extend the length of the sides 30 and 32.

The load bearing capability of materials used in making mattresses may be expressed as an indentation load deflection (ILD) rating and is expressed in pounds load per 50 square inches at a given percentage deflection of the foam. ILD as used herein ILD is determined by placing a square block of foam having a thickness of 4 inches and side dimensions of 15 inches on a flat surface and then compressing the foam with an 8-inch diameter plate (50 square inch area). To obtain the value, 50 square inch circular plate (a) is pushed into the foam top surface, stopping at a given deflection and reading a load or a scale. Mattress foam ILD's typically are for a deflection of 25%. A 25 percent ILD of 30 means that it takes 30 pounds load to compress a 4 inch thick piece of foam to a 3-inch thickness. The higher the load, the firmer the foam. ILD is the weight required to push the foam by 25% of its thickness. The ILD is the weight (force) required to depress the foam down to a thickness of 3 inches. The ILD of a foam material indicates its hardness or softness and has nothing to do with density.

Various materials known in the art may be used to form the layers 20, 22 and 24 and the support members 28 and 30. In a preferred embodiment of the invention, the top layer 20 is formed of a viscoelastic foam about 3⅝ in. thick having a density of 5.5 pounds per cubic foot and a 25% ILD of 13 pounds.

The intermediate layer 22 preferably is a high resiliency (HR) polyurethane foam about ⅜ in. thick having a density of 1.5 pounds per cubic foot and a 25% ILD of 26 pounds. The bottom layer 24 preferably is a foam material about 4½ in. thick having a density of 2.4 pounds per cubic foot and a 25% ILD of 32 pounds.

Figure 5:
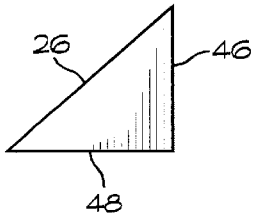
FIG. 5 is an end elevation view of a support member that may be included in the mattress according to the present invention.

The support members 26 and 28 preferably are formed of a very firm HR foam having a density of about 1.5 pounds per square foot and a 25% ILD of 32 pounds. The support members 26 and 28 are preferably generally identical and have vertical side edges 46 (shown in FIG. 5) that are about 3⅝ in. thick, which is the same as the top layer 20. The support members 26 and 28 preferably also have horizontal side edges 48 that are about 4 in. wide.

The support members 26 and 28 are firmer than the top layer. Therefore the support members 26 and 28 support the sides 30 and 32 of the top layer 20, which reduces the tendency of the portions of the mattress 18 near the sides 30 and 32 to compress when a weight such that of a person is positioned on the mattress 18 near one of the sides 30 or 32. Supporting the sides of the mattress provides increased comfort when a person sits on the side of the mattress and also reduces the likelihood that a person will accidentally roll off the mattress.

Figure 6:
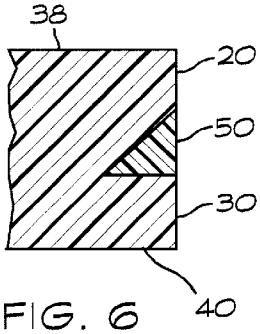
FIG. 6 is a cross sectional view showing a portion of an upper layer of a mattress according to the invention and a first alternate embodiment of a support member.

FIG. 6 shows a portion of the top layer 20 with a triangular cross section support member 50 located generally centrally between the upper surface 38 and the lower surface 40.

Figure 7:
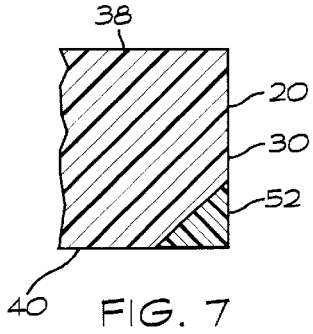
FIG. 7 is a cross sectional view showing a portion of an upper layer of a mattress according to the invention and a second alternate embodiment of a support member.

FIG. 7 shows a portion of the top layer 20 with a triangular cross section support member 52 located adjacent the lower surface 40 of the top layer 20.

Figure 8:
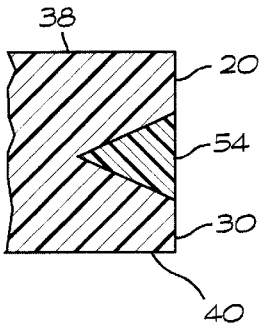
FIG. 8 is a cross sectional view showing a portion of an upper layer of a mattress according to the invention and a third alternate embodiment of a support member.

FIG. 8 shows a portion of the top layer 20 with another triangular cross section support member 54 located generally centrally between the upper surface 38 and the lower surface 40. The support member 54 tapers from the side 30 of the top layer toward the center thereof.

Figure 9:
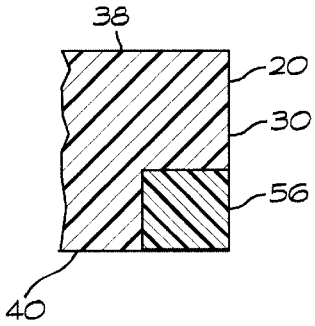
FIG. 9 is a cross sectional view showing a portion of an upper layer of a mattress according to the invention and a fourth alternate embodiment of a support member.

FIG. 9 shows a portion of the top layer 20 with a square cross section support member 56 adjacent the lower surface 40 of the top layer 20.

Figure 10:
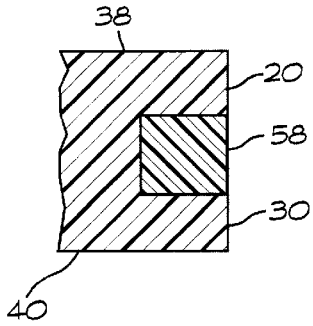
FIG. 10 is a cross sectional view showing a portion of an upper layer of a mattress according to the invention and a fifth alternate embodiment of a support member.

FIG. 10 shows a portion of the top layer 20 with a rectangular cross section support member 58 located generally centrally between the upper surface 38 and the lower surface 40.

Figure 11:
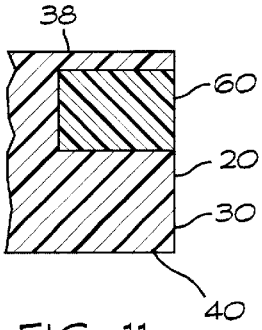
FIG. 11 is a cross sectional view showing a portion of an upper layer of a mattress according to the invention and a sixth alternate embodiment of a support member.

FIG. 11 shows a portion of the top layer 20 with a rectangular cross section support member 60 located near the upper surface 38.

Figure 12:
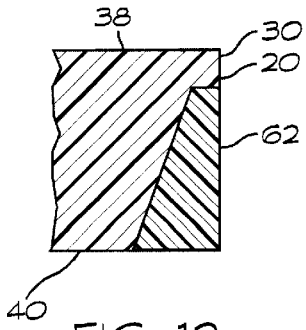
FIG. 12 is a cross sectional view showing a portion of an upper layer of a mattress according to the invention and a seventh alternate embodiment of a support member.

FIG. 12 6 shows a portion of the top layer 20 with a trapezoidal cross section support member 62 located generally adjacent the lower surface 40.

Figure 13:
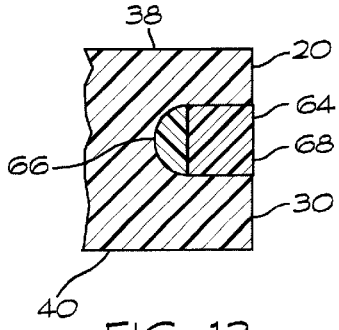
FIG. 13 is a cross sectional view showing a portion of an upper layer of a mattress according to the invention and an eighth alternate embodiment of a support member.

FIG. 13 shows a portion of the top layer 20 with a support member 64 that may be seen as having a generally semi circular cross section inner portion 66 and generally cross section rectangular outer portion 68.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A mattress comprising:

a top layer formed to comprise a viscoelastic foam material having a first indentation load deflection rating and an upper surface and a lower surface and first and second sides;

a buffer layer adjacent the lower surface of the top layer, the buffer layer being formed to comprise a foam material having a second indentation load deflection rating that is greater than the first indentation load deflection rating, the top layer being formed such;

a bottom layer arranged such that the buffer layer is between the top and bottom layers, the bottom layer being formed to comprise a foam material having a third indentation load deflection rating that is greater than the second indentation load deflection rating; and a first support member placed adjacent the first side of the top layer and the buffer layer; and a second support member placed adjacent the second side of the top layer and the buffer layer, the first and second support members being firmer than the top layer and being arranged to support the top layer and provide reduced compression of the mattress when a weight is placed on the upper surface of the top layer near the support members.

2. The mattress of claim 1 wherein the top layer is arranged to form first and second elongate wedge-shaped cavities between the first and second sides of the top layer and adjacent regions of the buffer layer and wherein the first and second support members comprise elongate wedge-shaped high resiliency foam structures positioned within the first and second cavities, respectively.

3. The mattress of claim 2 wherein the first and second support members have corresponding first and second outer edge portions arranged to have a thickness such that they extend from the upper surface of the top layer to the buffer layer.

4. The mattress of claim 3 wherein the top layer has a 25% indentation load deflection rating of about 13, the buffer layer has a 25% indentation load deflection rating of about 26, the bottom layer has and 25% indentation load deflection rating of about 32 and each of the first and second support members has a 25% indentation load deflection rating of about 32.

5. The mattress of claim 1 wherein the top layer is arranged to form first and second elongate rectangular cross section cavities between the first and second sides of the top layer and adjacent regions of the buffer layer and wherein the first and second support members comprise elongate high resiliency foam structures formed to fill the first and second cavities, respectively.

6. The mattress of claim 1 wherein the top layer is arranged to form first and second elongate trapezoidal cross section cavities between the first and second sides of the top layer and adjacent regions of the buffer layer and wherein the first and second support members comprise elongate high resiliency foam structures formed to fill the first and second cavities, respectively.

7. The mattress of claim 1 wherein the top layer is arranged to form first and second elongate cavities having generally semi circular cross section inner portions and generally rectangular cross section outer portions between the first and second sides of the top layer and adjacent regions of the buffer layer and wherein the first and second support members comprise elongate high resiliency foam structures arranged to fill the first and second cavities, respectively.

8. A method for forming a mattress comprising the steps of:

forming a top layer to have a first indentation load deflection rating;

placing a buffer layer having a second indentation load deflection rating that is greater than the first indentation load deflection rating adjacent the top layer;

arranging a bottom layer having a third indentation load deflection rating that is greater than the second indentation load deflection rating such that the buffer layer is between the top layer and the bottom layer;

forming the top layer to have first and second elongate cavities therein adjacent opposite side regions thereof; and placing first and second support members having a fourth indentation load deflection rating that is greater than the second indentation load deflection rating in the first and second cavities to support the top layer and provide reduced compression of the mattress when a weight is placed on the upper surface of the top layer near the support members.

9. The method of claim 8, further including the step of forming the first and second support members and the bottom layer to have substantially equal indentation load deflection ratings.

* * * * *